US009275602B2

(12) United States Patent
Kim

(10) Patent No.: US 9,275,602 B2
(45) Date of Patent: Mar. 1, 2016

(54) DISPLAY DEVICE AND METHOD OF DRIVING THE SAME

(71) Applicant: LG DISPLAY CO., LTD., Seoul (KR)

(72) Inventor: Young-Ho Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 396 days.

(21) Appl. No.: 13/731,606

(22) Filed: Dec. 31, 2012

(65) Prior Publication Data

US 2014/0043305 A1 Feb. 13, 2014

(30) Foreign Application Priority Data

Aug. 8, 2012 (KR) ..... 10-2012-0086789

(51) Int. Cl.
*G09G 5/00* (2006.01)
*G09G 3/20* (2006.01)

(52) U.S. Cl.
CPC .. *G09G 5/00* (2013.01); *G09G 3/20* (2013.01); *G09G 2230/00* (2013.01); *G09G 2310/02* (2013.01); *G09G 2310/027* (2013.01); *G09G 2310/0243* (2013.01); *G09G 2310/0259* (2013.01); *G09G 2310/0267* (2013.01); *G09G 2310/0278* (2013.01); *G09G 2310/06* (2013.01); *G09G 2310/066* (2013.01); *G09G 2310/067* (2013.01); *G09G 2310/08* (2013.01)

(58) Field of Classification Search
None
See application file for complete search history.

(56) References Cited

U.S. PATENT DOCUMENTS 7,142,187 B1 * 11/2006 Kim et al. ..... 345/100
2006/0103619 A1 * 5/2006 Kim ..... G09G 3/3677 345/98
2007/0070010 A1 * 3/2007 Oohira ..... G09G 3/3648 345/89
2007/0085799 A1 * 4/2007 Hong ..... G09G 3/3648 345/94
2007/0164969 A1 * 7/2007 Kim ..... G09G 3/3611 345/99
2008/0192031 A1 * 8/2008 An ..... G09G 3/2096 345/204
2009/0079718 A1 * 3/2009 Nakagawa ..... 345/204
2009/0096769 A1 * 4/2009 Kim ..... G09G 3/2096 345/204
2009/0146978 A1 * 6/2009 Ryu ..... G09G 3/3233 345/204
2009/0174691 A1 * 7/2009 Yeo ..... G09G 3/2096 345/204
2010/0302214 A1 * 12/2010 Kim ..... G09G 3/20 345/204
2011/0292028 A1 * 12/2011 Seo ..... G09G 3/2096 345/213
2012/0139882 A1 * 6/2012 Kim ..... G09G 5/008 345/204
2012/0162291 A1 * 6/2012 Kim ..... G09G 5/008 345/691
2012/0169686 A1 * 7/2012 Kim ..... G09G 3/2096 345/208
2012/0194488 A1 * 8/2012 Park ..... G09G 3/2096 345/204
2012/0256855 A1 * 10/2012 Chan ..... G06F 3/0418 345/173
2012/0306858 A1 * 12/2012 Song ..... G09G 3/003 345/419

* cited by examiner

*Primary Examiner* — Kathy Wang-Hurst
*Assistant Examiner* — Josemarie G Acha, III
(74) *Attorney, Agent, or Firm* — Birch, Stewart, Kolasch & Birch, LLP

(57) ABSTRACT

A display device including a display panel including gate and data line that cross each other; a first control signal generation unit generating a source output enable signal and a first gate output enable signal in synchronization with a data enable signal modulated according to a spread frequency clock signal; a second control signal generation unit counting a number of clocks of a fixed-frequency clock signal based on a point of time at which a logic high state of the source output enable signal ends, and outputting a second gate output enable signal when the number of the counted clocks becomes equal to a reference value; and a gate driving unit controlling outputting of a gate signal to the gate lines using the second gate output enable signal.

4 Claims, 2 Drawing Sheets

DISPLAY DEVICE AND METHOD OF DRIVING THE SAME

The present application claims the priority benefit of Korean Patent Application No. 10-2012-0086789 filed in Republic of Korea on Aug. 8, 2012, which is hereby incorporated by reference in its entirety.

BACKGROUND

1. Field of the Disclosure

The present disclosure relates to a display device, and more particularly, to a display device and a method of driving the same.

2. Discussion of the Related Art

With the advancement of information society, demand for a display device capable of displaying an image has increased in various forms. Recently, various flat panel display devices, such as a liquid crystal display (LCD), a plasma display panel (PDP), and an organic light emitting diode (OLED), have been used.

Among various flat panel display devices, an active matrix LCD device in which a switching transistor is formed in each of pixels arranged in a matrix has been commonly used.

Recently, a display device having high frequency and resolution has been developed to display a high-quality image.

Thus, an amount of data transmitted between driving circuits that perform signal transmission increases, thereby causing electro-magnetic interference (EMI) to occur. To solve this problem, a spread spectrum technique has been suggested.

In the spread spectrum technique, a particular frequency band is spread and signal transmission is performed by periodically changing a frequency in the spread frequency bandwidth. Thus, EMI that may occur when a signal is transmitted at a particular frequency may be prevented.

However, in the related art spread spectrum technique, driving control signals are generated by a timing controller in synchronization with a spread frequency clock signal. Thus, a time of charging image data changes according to a change in a frequency of the spread frequency clock signal.

Accordingly, the time of charging the image data may change in units of horizontal periods or frames, and wavy noise may occur in this case, thereby degrading image quality.

SUMMARY OF THE INVENTION

Accordingly, the present invention is directed to a display device capable of preventing degradation in image quality and a method of driving the same.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, a display device includes including gate data lines that cross each other; a first control signal generation unit generating a source output enable signal and a first gate output enable signal in synchronization with a data enable signal modulated according to a spread frequency clock signal; a second control signal generation unit counting a number of clocks of a fixed-frequency clock signal based on a point of time at which a logic high state of the source output enable signal ends, and outputting a second gate output enable signal when the number of the counted clocks becomes equal to a reference value; and a gate driving unit controlling outputting of a gate signal to the gate lines using the second gate output enable signal.

In another aspect, a method of driving a display device includes generating a source output enable signal and a first gate output enable signal in synchronization with a data enable signal modulated according to a spread frequency clock signal, performed by a first control signal generation unit; counting a number of clocks of a fixed-frequency clock signal based on a point of time at which a logic high state of the source output enable signal ends, and outputting a second gate output enable signal when the number of the counted clocks becomes equal to a reference value, performed by a second control signal generation unit; and controlling outputting of a gate signal from a gate driving unit to a display panel using the second gate output enable signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to exemplary embodiments, examples of which are illustrated in the accompanying drawings.

Figure 1:
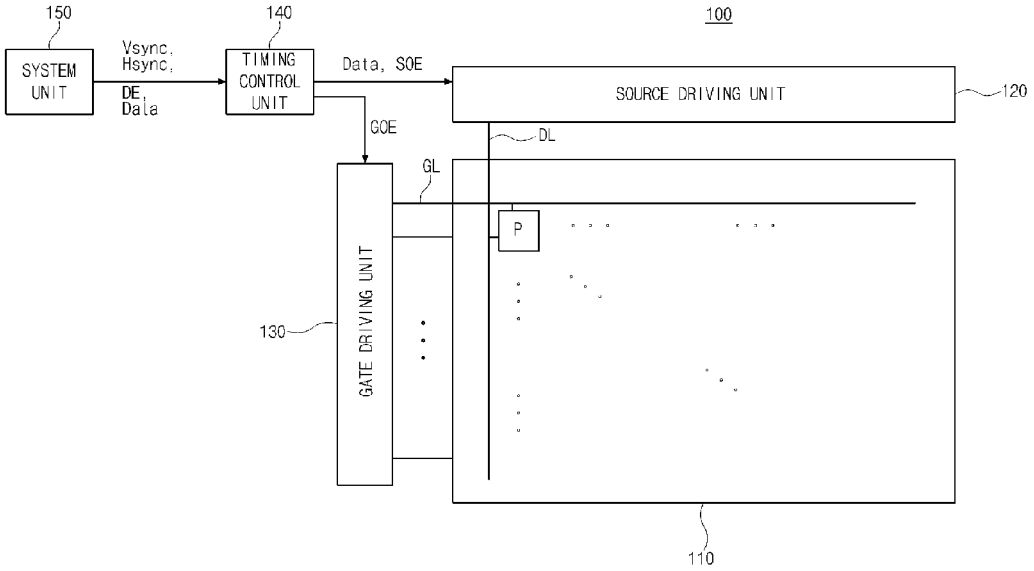
FIG. 1 is a schematic block diagram of a display device according to an embodiment of the present invention.
Figure 2:
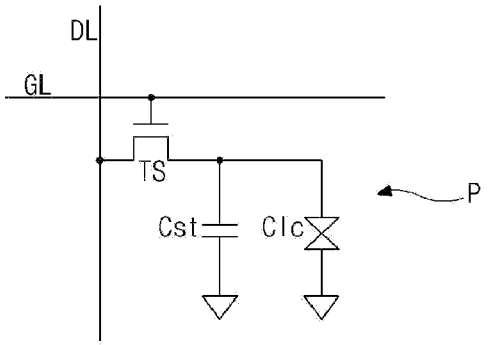
FIG. 2 is a schematic circuit diagram of a pixel of FIG. 1 according to an embodiment of the present invention.

FIG. 1 is a schematic block diagram of a display device 100 according to an embodiment of the present invention. FIG. 2 is a schematic circuit diagram of a pixel P of FIG. 1 according to an embodiment of the present invention Referring to FIGS. 1 and 2, the display device 100 may include a display panel 110 and a driving circuit unit that drives the display panel 110.

The driving circuit unit may include a source driving unit 120, a gate driving unit 130, a timing control unit 140, and a system unit 150.

The display panel 110 is configured to display an image, and includes a plurality of pixels P arranged in a matrix. Also, in the display panel 110, gate lines GL and data lines DL that cross one another are formed. Each of the gate lines GL and each of the data lines DL are connected to a corresponding pixel P among the plurality of pixels P.

The plurality of pixels P may include red (R) pixels displaying red, green (G) pixels displaying green, and blue (B) pixels displaying blue. The R, G, and B pixels may be alternately arranged in rows, and adjacent R, G, and B pixels may act as a unit of image display.

Examples of the display panel 110 may include various types of flat display panels, such as a liquid crystal display (LCD) panel, a field-emission display panel, a plasma display panel, an electroluminescent display panel (e.g., an inorganic field-effect electroluminescent panel and an organic light emitting diode panel), and an electrophoretic display panel.

When the display panel 110 is an LCD panel, the display panel may further include a backlight unit that supplies light to the LCD panel.

In this case, referring to FIG. 2, the pixel P may include a switching transistor TS and a liquid crystal capacitor Clc connected to a gate line GL and a data line DL. The liquid crystal capacitor Clc includes a pixel electrode and a common electrode that correspond to each other, and a liquid crystal layer between the pixel electrode and the common electrode. The pixel P may further include a storage capacitor Cst for storing input image data therein.

When the display panel 110 is an organic light emitting diode panel, the pixel P may include a switching transistor connected to a gate line GL and a data line DL, a driving transistor connected to the switching transistor, and an organic light emitting diode connected to the driving transistor.

The timing control unit 140 receives timing signals, e.g., a vertical synchronization signal Vsync, a horizontal synchronization signal Hsync, and a data enable signal ED, from the system unit 150 via an interface, e.g., a low-voltage differential signaling (LVDS) interface or a transition minimized differential signaling (TMDS) interface.

The timing control unit 140 may generate a source control signal that controls the source driving unit 120 and a gate control signal that controls the gate driving unit 130, based on the timing signals. The source control signal includes a source output enable signal SOE that controls a timing at which image data is output from the source driving unit 120, and the gate control signal includes a gate output enable signal GOE that controls a timing at which a gate signal is output from the gate driving unit 130.

The timing control unit 140 receives image data Data in the form of a digital signal from the system unit 150, processes the image data Data, and supplies the processed image data Data to the source driving unit 120.

The source driving unit 120 may include, for example, a plurality of driving integrated circuits (ICs). The plurality of driving ICs may be connected to the display panel 110 according to a chip on glass (COG) process or a chip on film (COF) process to be connected to the corresponding data lines DL.

The source driving unit 120 receives the processed image data Data and the source control signal from the timing control unit 140, and outputs image data in the form of an analog signal to the corresponding data lines DL according to the processed image data Data and the source control signal. For example, the source driving unit 120 transforms the processed image data Data into image data in parallel form according to the source control signal, transforms the parallel image data into a positive/negative polarity voltage, and applies the positive/negative polarity voltage to the corresponding data lines DL.

Although not shown, the display device 100 may include a gamma voltage unit. The gamma voltage unit generates a gamma voltage and applies the gamma voltage to the source driving unit 120. A voltage corresponding to the image data Data in the form of a digital signal may be generated using the gamma voltage.

The gate driving unit 130 sequentially supplies a gate signal to the gate lines GL according to the gate control signal that is received directly from the timing control unit 140 or that is received via the source driving unit 120. The gate driving unit 130 may include a plurality of driving ICs but is not limited thereto. For example, the gate driving unit 130 may be included in the display panel 110 according to a gate in panel (GIP) method. In this case, the gate driving unit 130 is formed in a non-display region of an array substrate during manufacture of the array substrate.

The display device 100 having the structure described above may be driven according to the spread spectrum technique. In this case, a time of charging the image data Data may be maintained constant by controlling timing of the gate output enable signal GOE, as will be described in detail with reference to FIGS. 3 and 4 below.

Figure 3:
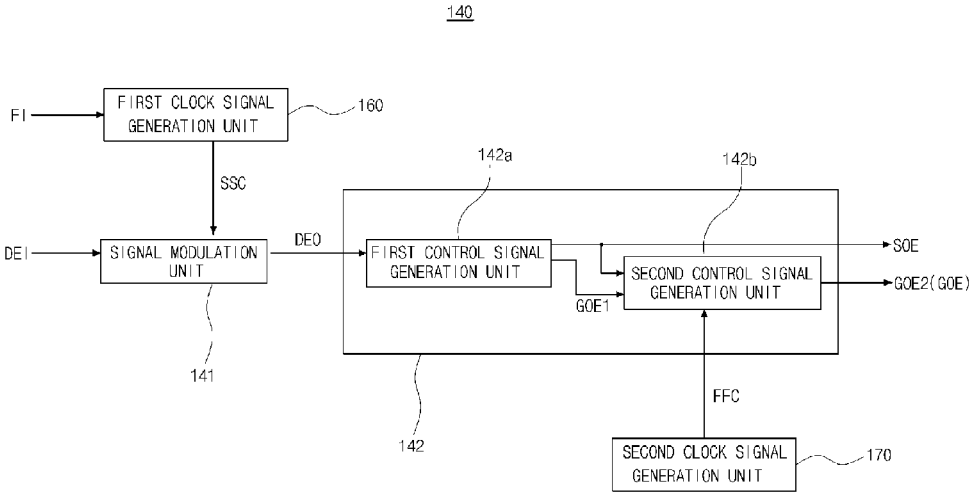
FIG. 3 is a schematic block diagram of a timing control unit according to an embodiment of the present invention.
Figure 4:
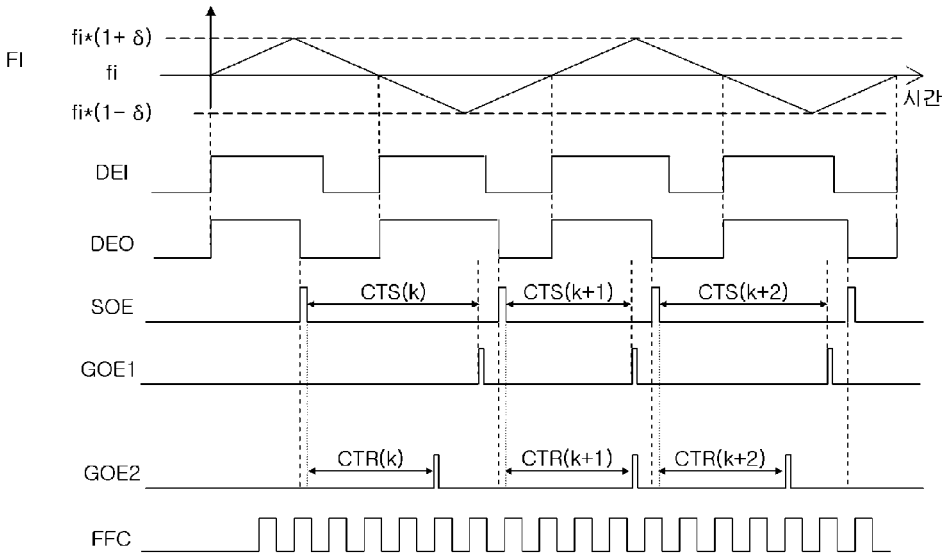
FIG. 4 is a timing diagram of signals for driving a display device according to an embodiment of the present invention.

FIG. 3 is a schematic block diagram of a timing control unit 140 according to an embodiment of the present invention. FIG. 4 is a timing diagram of signals for driving a display device according to an embodiment of the present invention.

Referring to FIG. 3, the timing control unit 140 may include a signal modulation unit 141 and a control signal generation unit 142.

The signal modulation unit 141 may receive a data enable signal DE, for example, from the system unit 150 of FIG. 1, modulate the data enable signal DE, and output the modulated data enable signal DE. According to the current embodiment, for convenience of explanation, the data enable signal input to and the modulated data enable signal DEIN output from the signal modulation unit 141 will be referred to as a first data enable signal DEI and a second data enable signal DEO, respectively.

Such a timing signal modulation process may be performed using a spread frequency clock signal SSC.

The spread frequency clock signal SSC may be generated by and output from a first clock signal generation unit 160 included in the display device 100 of FIG. 1. The first clock signal generation unit 160 receives an input frequency clock signal FI having a fixed frequency fi, and generates the spread frequency clock signal SSC by spreading the fixed frequency fi according to the spread spectrum technique.

The spread frequency clock signal SCC has a spread width (i.e., frequency band) of ($fi \times 2\delta$) based on the input frequency fi, and has a form in which a frequency thereof periodically changes. In the current embodiment, for convenience of explanation, a case in which a frequency of the spread frequency clock signal SSC changes at intervals of two horizontal periods is described.

The frequency of the spread frequency clock signal SSC that varies according to time may have any of various shapes, e.g., a triangular wave shape and a sine wave shape. In the current embodiment, it is assumed that for convenience of explanation, the frequency of the spread frequency clock signal SSC that varies according to time has the triangular wave shape.

The input frequency clock signal FI described above may be supplied from the system unit 150 but is not limited thereto. For example, the input frequency clock signal FI may be generated by the timing control unit 140.

The first clock signal generation unit 160 may be included in the timing control unit 140 but is not limited thereto. For example, the first clock signal generation unit 160 may be included in the system unit 150.

The spread frequency clock signal SSC generated as described above is supplied to the signal modulation unit 141. The signal modulation unit 141 modulates the first data enable signal DEI according to the spread frequency clock signal SCC.

In this connection, for example, in a frequency section in which the frequency of the spread frequency clock signal SSC is higher than the input frequency fi, the frequency of a clock signal related to signal transmission, e.g., an internal clock signal, becomes high and signal transmission may thus be performed at high speeds. In contrast, in a frequency section in which the frequency of the spread frequency clock signal SSC is lower than the input frequency fi, the frequency of the internal clock signal becomes low and signal transmission may thus be performed at low speeds. Thus, the signal modulation unit 141 may count the number of clocks of, for example, the internal clock signal, and maintain the first data enable signal DEI in an enable state, e.g., in a logic high state, until a result of the counting becomes equal to a set significant number.

Then, as illustrated in FIG. 4, in the frequency section in which the frequency of the spread frequency clock signal SSC is higher than the input frequency fi, a point of time at which a logic high state of the first data enable signal DEI ends, i.e., a falling edge of the first data enable signal DEI, is advanced. In the frequency section in which the frequency of the spread frequency clock signal SSC is lower than the input frequency fi, the falling edge of the first data enable signal DEI in the logic high state is relatively delayed.

As described above, timing of the input first data enable signal DEI may change according to a change in the frequency of the spread frequency clock signal SSC. That is, the timing of the first data enable signal DEI is also dispersed.

As described above, the signal modulation unit 141 may modulate the first data enable signal DEI according to the spread frequency clock signal SSC and output the modulated second data enable signal DEO.

The output modulated second data enable signal DEO is supplied to the control signal generation unit 142. The control signal generation unit 142 may include a first control signal generation unit 142*a* and a second control signal generation unit 142*b*.

The first control signal generation unit 142*a* generates a source output enable signal SOE and a gate output enable signal GOE1 from the modulated second data enable signal DEO. Alternatively, the gate output enable signal GOE1 may be generated using another timing signal and a clock signal. For convenience of explanation, the gate output enable signal GOE1 generated by and output from the first control signal generation unit 142*a* will now be referred to as 'first gate output enable signal GOE1.'

The source output enable signal SOE and the first gate output enable signal GOE1 are generated in synchronization with the second data enable signal DEO. For example, the source output enable signal SOE is output at a falling edge of the second data enable signal DEO, and the first gate output enable signal GOE1 is output at a certain point of time before the falling edge of the second data enable signal DEO.

As described above, a timing of falling edges of the second data enable signal DEO varies according to a frequency change, thereby changing timings of the source output enable signal SOE and the first gate output enable signal GOE1.

Thus, an interval between a point of time at which a logic high state of the source output enable signal SOE ends, i.e. a falling edge of the source output enable signal SOE, and a point of time at which a logic high state of the first gate output enable signal GOE1 starts, i.e., a rising edge of the first gate output enable signal GOE1, also changes.

Accordingly, in the related art, when image data is charged using the source output enable signal SOE and the first gate output enable signal GOE1, a time of charging the image data may change according to a frequency change, thereby causing wavy noise to occur.

To solve this problem, according to an embodiment of the present invention, the second control signal generation unit 142*b* is configured to control timing of outputting the gate output enable signal GOE supplied to the gate driving unit 130. In other words, the gate output enable signal GOE (i.e., the second gate output enable signal GOE2), the output timing of which is controlled to uniformize the time of charging the image data, is generated, as will be described in detail below.

For convenience of explanation, the interval between the falling edge of the source output enable signal SOE and the rising edge of the first gate output enable signal GOE1 will be referred to as a variable charging time (CTS).

The second control signal generation unit 142*b* receives the source output enable signal SOE, the first gate output enable signal GOE1, and a fixed-frequency clock signal FFC, and generates the second gate output enable signal GOE2 using the source output enable signal SOE, the first gate output enable signal GOE1, and the fixed-frequency clock signal FFC.

The fixed-frequency clock signal FFC may be generated by the second clock signal generation unit 170 that is not influenced by the spread spectrum technique. Thus, even if a display device is driven according to the spread spectrum technique, the fixed-frequency clock signal FFC having a fixed frequency may be generated and supplied.

The second clock signal generation unit 170 may be a voltage-controlled oscillator (VCO) that is not influenced by the spread spectrum technique but is not limited thereto. The second clock signal generation unit 170 may be included in the timing control unit 140 but is not limited thereto. For example, the second clock signal generation unit 170 may be included in the system unit 150 outside the timing control unit 140.

The second control signal generation unit 142*b* counts the number of clocks of the fixed-frequency clock signal FFC. Specifically, for example, the number of clocks of the fixed-frequency clock signal FFC from a falling edge of the source output enable signal SOE to a corresponding rising edge of the first gate output enable signal GOE1 is counted in units of rows, i.e., in units of horizontal periods, of an $(m-1)^{th}$ frame. In other words, the number of clocks of the fixed-frequency clock signal FFC for the variable charging time CTS is counted. For convenience of explanation, the number of clocks counted for the variable charging time CTS is referred to as a first count value.

Then, an average of first count values is calculated. For example, if the number of horizontal periods (rows) is n and a first count value in a $k^{th}$ horizontal period is CK(k), an average Avg of first count values in the $(m-1)^{th}$ frame may be calculated using an equation: $Avg(m-1)=(CK(1)+\ldots+CK(n))/n$.

The second gate output enable signal GOE2 in an $m^{th}$ frame may be generated by setting the average Avg of the first count values in the $(m-1)^{th}$ frame as a reference value.

In this connection, for example, in the $m^{th}$ frame, the number of clocks of the fixed-frequency clock signal FFC based on a falling edge of the source output enable signal SOE is counted. For convenience of explanation, the number of clocks of the fixed-frequency clock signal FFC counted starting from the falling edge of the source output enable signal SOE is referred to as a second count value.

When the second count value becomes equal to a set reference value, i.e., an average Avg of first count values in the $(m-1)^{th}$ frame, the second gate output enable signal GOE2 is generated and output.

Thus, timing of outputting the second gate output enable signal GOE in each of horizontal periods in the $m^{th}$ frame happens to coincide with timing of outputting the source output enable signal SOE. Thus, even if the timing of outputting the source output enable signal SOE changes according to the spread spectrum technique, the interval between the falling edge of the source output enable signal SOE and the rising edge of the second gate output enable signal GOE2, i.e., an actual time CTR of charging image data, may be maintained constant.

Thus, problems occurring when a time of charging image data periodically changes, e.g., wavy noise, may be prevented, thereby improving image quality of a display device.

As described above, according to an embodiment of the present invention, the number of clocks of a fixed-frequency clock signal is counted based on timing of a source output enable signal, and a gate output enable signal is output when the number of the counted clocks of the fixed-frequency clock signal becomes equal to a set value. Thus, even if the spread spectrum technique is employed, a time of charging image data may be uniformized.

Accordingly, wavy noise that may occur when the time of charging image data changes may be prevented, thereby improving image quality.

It will be apparent to those skilled in the art that various modifications and variations can be made in a display device of the present disclosure without departing from the sprit or scope of the invention. Thus, it is intended that the present invention covers the modifications and variations of this invention provided they come within the scope of the appended claims and their equivalents.

What is claimed is:

1. A display device comprising:

a display panel including gate and data lines that cross each other;

a first control signal generation unit generating a source output enable signal and a first gate output enable signal in synchronization with a data enable signal modulated according to a spread frequency clock signal;

a second control signal generation unit counting a number of clocks of a fixed-frequency clock signal based on a point of time at which a logic high state of the source output enable signal ends, and outputting a second gate output enable signal when the number of the counted clocks becomes equal to a reference value; and a gate driving unit controlling outputting of a gate signal to the gate of the gate line using the second gate output enable signal, wherein the second control signal generation unit counts the number of clocks of the fixed-frequency clock signal from a point of time at which the logic high state of the source output enable signal ends to a point of time at which a logic high state of the first gate output enable signal starts, in units of n horizontal periods of an $(m-1)^{th}$ frame; calculates the reference value by calculating an average of the numbers of clocks counted at every n horizontal periods; and generates the second gate output enable signal in an $m^{th}$ frame using the calculated average;

wherein m and n are positive integers.

2. The display device of claim 1, further comprising a clock signal generation unit receiving an input frequency dock signal having a fixed frequency, and generating the spread frequency clock signal, the frequency of which is dispersed according to a spread spectrum technique, based on the input frequency clock signal.

3. A method of driving a display device, comprising:

generating a source output enable signal and a first gate output enable signal in synchronization with a data enable signal modulated according to a spread frequency clock signal, performed by a first control signal generation unit;

counting a number of clocks of a fixed-frequency clock signal based on a point of time at which a logic high state of the source output enable signal ends, and outputting a second gate output enable signal when the number of the counted clocks becomes equal to a reference value, performed by a second control signal generation unit; and controlling outputting of a gate signal from a gate driving unit to a display panel using the second gate output enable signal, wherein the outputting of the second gate output enable signal comprises:

counting the number of clocks of the fixed-frequency clock signal from a point of time at which the logic high state of the source output enable signal ends to a point of time at which a logic high state of the first gate output enable signal starts, in units of n horizontal periods of an $(m-1)^{th}$ frame;

calculating the reference value by calculating an average of the number of clocks counted at every n horizontal periods; and generating the second gate output enable signal in an $m^{th}$ frame using the reference value;

wherein m and n are positive integers.

4. The method of claim 3, further comprising receiving an input frequency clock signal having a fixed frequency, and generating the spread frequency clock signal, the frequency of which is dispersed according to a spread spectrum technique, based on the input frequency clock signal.

* * * * *